US011492909B2

(12) United States Patent
Vachon

(10) Patent No.: US 11,492,909 B2
(45) Date of Patent: Nov. 8, 2022

(54) PLATFORM SEAL AND DAMPER ASSEMBLY FOR TURBOMACHINERY AND METHODOLOGY FOR FORMING SAID ASSEMBLY

(71) Applicant: DRESSER-RAND COMPANY, Houston, TX (US)

(72) Inventor: Nicholas Vachon, Olean, NY (US)

(73) Assignee: DRESSER-RAND COMPANY, Houston, TX (US)

( * ) Notice: Subject to any disclaimer, the term of this patent is extended or adjusted under 35 U.S.C. 154(b) by 0 days.

(21) Appl. No.: 17/414,816

(22) PCT Filed: Aug. 7, 2019

(86) PCT No.: PCT/US2019/045436
§ 371 (c)(1),
(2) Date: Jun. 16, 2021

(87) PCT Pub. No.: WO2020/142113
PCT Pub. Date: Jul. 9, 2020

(65) Prior Publication Data

US 2022/0018256 A1 Jan. 20, 2022

Related U.S. Application Data

(60) Provisional application No. 62/787,533, filed on Jan. 2, 2019.

(51) Int. Cl.
*F01D 5/08* (2006.01)
*F01D 11/08* (2006.01)
*F01D 25/12* (2006.01)

(52) U.S. Cl.
CPC ..... *F01D 5/085* (2013.01); *F01D 11/08* (2013.01); *F01D 25/12* (2013.01);
(Continued)

(58) Field of Classification Search
CPC ..... F01D 5/085; F01D 5/3007; F01D 5/3015; F01D 5/22; F01D 5/26; F01D 11/006;
(Continued)

(56) References Cited

U.S. PATENT DOCUMENTS 9,822,644 B2 * 11/2017 Tardif ..... F01D 5/22
10,012,085 B2 * 7/2018 Hough ..... F01D 5/26
(Continued)

FOREIGN PATENT DOCUMENTS

EP 1600606 A1 11/2005
EP 3054103 A1 8/2016
(Continued)

OTHER PUBLICATIONS

PCT International Search Report and Written Opinion dated Jun. 19, 2020 corresponding to PCT Application No. PCT/US2019/045436 filed Aug. 7, 2019.

*Primary Examiner* — Igor Kershteyn

(57) ABSTRACT

A platform seal and damper assembly for turbomachinery (100), such as fluidized catalytic cracking (FCC) expanders or gas turbine engines; and methodologies for forming such assembly are provided. An axially-extending groove (160) is arranged on a side (162) of a respective platform. Groove (160) is defined by a radially-outward surface (168) at an underside of the platform and a surface (170) extending with a tangential component (T) toward radially-outward surface (168). A seal and damper member (152) is disposed in groove (160), where the body of seal and damper member has adjoining surfaces (190, 188) configured to respectively engage, in response to a camming action, with the surfaces (168, 170) that define the axially-extending groove. The camming action being effective to produce an interference fit
(Continued)

of the seal and damper member (152) with the side of the respective platform (162) and an opposed side (163) of an adjacent platform.

16 Claims, 6 Drawing Sheets

(52) U.S. Cl.
CPC ..... *F05D 2220/30* (2013.01); *F05D 2230/12* (2013.01); *F05D 2230/30* (2013.01); *F05D 2240/24* (2013.01)

(58) Field of Classification Search
CPC ..... F01D 11/08; F01D 25/06; F05D 2220/30; F05D 2230/12; F05D 2230/11; F05D 2230/30
See application file for complete search history.

(56) References Cited

U.S. PATENT DOCUMENTS

| | | | | |
|---|---|---|---|---|
| 10,100,648 | B2 * | 10/2018 | Niezelski | F16F 15/04 |
| 10,107,125 | B2 * | 10/2018 | Rioux | F01D 11/001 |
| 10,113,434 | B2 * | 10/2018 | Snyder | F01D 5/22 |
| 2006/0263204 | A1 | 11/2006 | London et al. | |
| 2014/0119918 | A1 | 5/2014 | Tarczy et al. | |

FOREIGN PATENT DOCUMENTS

| | | | |
|---|---|---|---|
| GB | 1271363 | A | 4/1972 |
| WO | 2017136625 | A1 | 8/2017 |

* cited by examiner

PLATFORM SEAL AND DAMPER ASSEMBLY FOR TURBOMACHINERY AND METHODOLOGY FOR FORMING SAID ASSEMBLY

CROSS-REFERENCE TO RELATED APPLICATIONS

This application claims benefit of the Jan. 2, 2019 filing date of U.S. provisional application 62/787,533, which is incorporated by reference herein.

BACKGROUND

1. Field

Disclosed embodiments relate generally to the field of turbomachinery, such as may involve fluidized catalytic cracking (FCC) expanders or gas turbine engines, and, more particularly, to a blade platform seal and damper assembly, and, methodology for forming said assembly.

2. Description of the Related Art

An FCC process may be used to convert high-molecular weight hydrocarbon fractions of petroleum crude oils to usable products (e.g., gasoline) with the aid of a catalyst in a reactor. High-temperature flue gas may be produced in connection with the FCC process, and the high-temperature flue gas may be passed through an FCC expander to extract and convert energy from the flue gas into mechanical work that may be used to drive process machinery. Although the flue gas may be processed through one or more stages of separation, an undesirable amount of catalyst particulates can remain entrained in the flue gas that is passed through the FCC expander.

The relatively high temperatures involved, the corrosive nature, and the erosive tendency of the hot, catalyst particulate laden flue gas may cause rapid deterioration by erosion and/or by corrosion of rotating and stationary components of the FCC expander, including but not limited to, the inlet, the rotor assembly including the rotor disc and blades, and the stator assembly. In particular, the rim of the rotor disc and the respective roots of the rotor blades attached to the rotor disc are susceptible to catalyst build up during operation. This region of the FCC expander may also subject to turbulent and varying flows, which can exacerbate the foregoing issues.

For one example of structures used in connection with an FCC expander, reference is made to International Patent Application PCT/US2017/016348, titled "Systems and Methods for Cooling a Rotor Assembly Disposed Within a Cavity of an Expander Fluidly Coupled with a Cooling Source".

DETAILED DESCRIPTION

Figure 1:
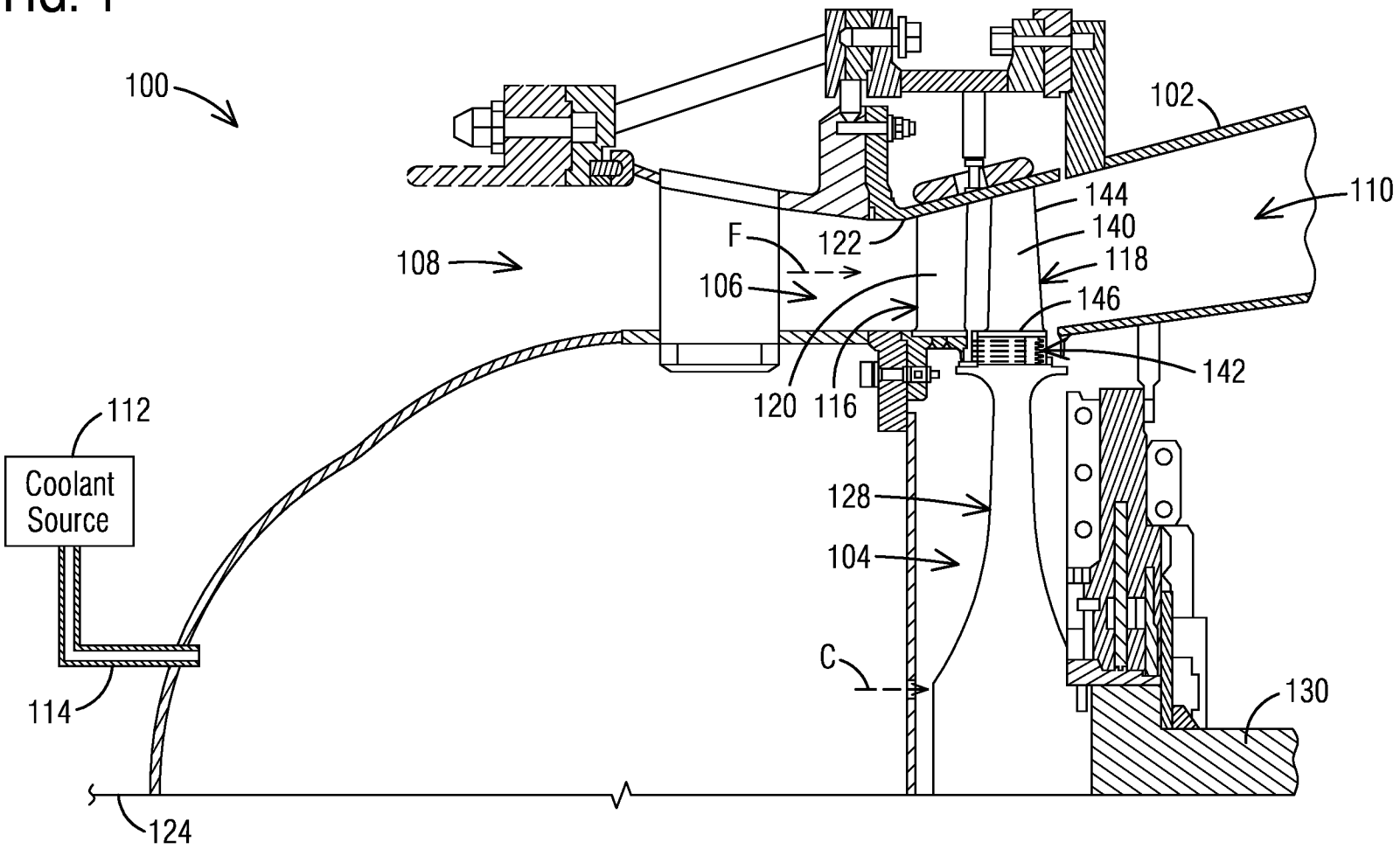
FIG. 1 is a fragmentary, cross-sectional view of one non-limiting example of turbomachinery, such as a fluidized catalytic cracking (FCC) expander that can benefit from disclosed embodiments.

As noted above, certain prior art turbomachinery, such as expanders/turbines, that may be involved in connection with FCC processes may be exposed to relatively high-temperature flue gas that can include corrosive particulates. These corrosive particulates have the potential to shorten the life of components that are exposed to the high-temperature flue gas. The present inventor has recognized that certain exposed areas may encompass highly thermo-mechanically stressed regions, such as where rotor blades may be attached to the rotor disc. Accordingly, in view of such recognition, disclosed assemblies—in a cost-effective and reliable manner—provide a sealing functionality, which avoids or substantially reduces exposure of such regions to the high-temperature flue gas.

Additionally, unsteady aerodynamic excitations can develop during the operation of the turbomachinery, and these excitations can subject the rotor blades to dynamically changing loads. These dynamically changing loads can result in elastic displacements near blade attachment areas and in the blade platform and, in turn, these displacements can result in dynamically changing stresses that can lead to premature failure of the involved structures. The present inventor has further recognized that certain prior art damping designs tend to rely on frictional surface interactions in the firtree attachment area to dampen effects of such excitations. Consequently, the damping provided by such prior art designs may be limited to the firtree attachment area and practically not available radially beyond the upper firtree interface.

Accordingly, in view of such further recognition disclosed assemblies further provide a damping functionality, which substantially attenuates such excitations and thus substantially reduce the potential of structural fatigue of the involved structures. Disclosed assemblies additionally offer a novel technical solution involving a camming action, such as by way of interaction of camming surfaces in a disclosed seal and damper member with corresponding surfaces in a groove of disclosed blade platform to achieve superior sealing functionality that, for example, extends the dampened region beyond the upper firtree interface and thus is conducive to a more effective dampening of the blade platform. Without limitation, this feature is believed to provide a significant technical advantage over prior art design in terms of providing blade damping before the dynamically changing loads can reach the highly stressed firtree attachment area.

The present inventor has additionally recognized that the sealing and damping functionality provided by disclosed assemblies should be continually and reliably provided during operation of the turbomachinery, notwithstanding of dynamically changing operational conditions that may occur, such as dynamically changing loads and/or exposure to thermal gradients. Accordingly, disclosed assemblies are designed to consistently remain engaged between any two adjacent blade platforms, notwithstanding of dynamically changing operational conditions that may occur during operation of the turbomachinery to effectively provide appropriate damping and sealing to the involved structures.

The present inventor has yet further recognized that traditional manufacturing techniques may not be necessarily conducive to a cost-effective and/or realizable manufacture of certain components that may be involved to efficiently implement the foregoing sealing and damping structures. For example, traditional manufacturing techniques tend to fall short from consistently limiting manufacturing variability; and may also fall short from cost-effectively and reliably producing relatively complex geometries such as may be involved in certain disclosed components.

In view of this further recognition, in one non-limiting embodiment, the present inventor further proposes use of three-dimensional (3D) Printing/Additive Manufacturing (AM) technologies, such as laser sintering, selective laser melting (SLM), direct metal laser sintering (DMLS), electron beam sintering (EBS), electron beam melting (EBM), etc., that may be conducive to cost-effective fabrication of a seal and damper member, which is a component of a disclosed platform seal and damper assembly. For readers desirous of general background information in connection with 3D Printing/Additive Manufacturing (AM) technologies, see, for example, a textbook titled "Additive Manufacturing Technologies, 3D Printing, Rapid Prototyping, and Direct Digital Manufacturing", by Gibson I., Stucker B., and Rosen D., 2010, published by Springer, which is incorporated herein by reference.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

FIG. 1 illustrates a fragmentary, cross-sectional view of one non-limiting example of turbomachinery 100, such as an expander that can benefit from disclosed embodiments. Without limitation, expander 100 may be an FCC expander configured to extract and convert energy from a high-temperature flue gas into mechanical work that may be used to drive process machinery, an electrical generator, etc. Expander 100 may be utilized in an FCC process, such as disclosed above, or in any other application that may involve a high-temperature gas.

As illustrated in FIG. 1, expander 100 is a single-stage expander; however, it will be appreciated that expander 100 may be a multi-stage expander. A configuration of expander 100 may be tailored based on the needs of any given application. Without limitation, expander 100 may be configured to produce power in a range from approximately 3000 hp (~2.2 MW) to approximately 60,000 hp (~45 MW). It will be appreciated that disclosed embodiments are not limited to any particular level of power generation. Components of expander 100 may be constructed from one or more corrosion resistant materials. In one non-limiting embodiment, one or more components of expander 100 may be constructed from a superalloy, such as Inconel 718 or similar.

As shown in FIG. 1, expander 100 may include a casing or housing 102 defining a cavity 104 and a flow path 106 extending from a flue gas inlet 108 to a flue gas outlet 110. The flue gas (schematically represented by arrow F) received at the flue gas inlet 108 may, without limitation, have a temperature in a range from about 650° C. to about 800° C. Accordingly, in one non-limiting embodiment, expander 100 may be fluidly coupled with a coolant source 112 via one or more conduits 114. The coolant source may be a steam generation plant or process component (e.g., boiler) capable of supplying a coolant (schematically represented by arrow C), for example, steam or air, to expander 100. In one non-limiting embodiment, coolant source 112 may be a boiler capable of supplying steam via one or more conduits 114 to cavity 104 of the expander 100 to cool one or more rotating or stationary components of expander 100.

As illustrated in FIG. 1, expander 100 may include a stator assembly 116 and a rotor assembly 118 axially spaced and downstream from stator assembly 116. Stator assembly 116 may include a plurality of stator vanes 120 coupled to or adjacent (e.g., a clearance may be therebetween) an inner surface 122 of housing 102 and disposed circumferentially about and extending radially outward from a center axis 124 of expander 100.

Rotor assembly 118 may include a rotor disc 128 disposed in cavity 104 and axially spaced from stator assembly 116. Rotor disc 128 may be coupled to or integral with a rotary shaft 130 of expander 100 and thus may be configured to rotate with rotary shaft 130 about center axis 124. That is, center axis 124 may be referred to as a rotation axis.

Rotor assembly 118 may further include a plurality of rotor blades 140 attached to rotor disc 128 and configured to rotate about center axis 124 in response to flow of flue gas (arrow F) that may be directed by stator vanes 120. Each rotor blade 140 may include a blade platform 146 interposed between a root 142 and an airfoil 144. Each root 142 may be configured to be inserted into and retained in a respective slot that may be defined by rotor disc 128 via any retaining structure or technique known to those of skill in the art.

In one non-limiting embodiment, each root 142 may be shaped in the form of a fir tree and retained in a respective matching slot. As disposed in expander 100, a respective airfoil 144 of each rotor blade 140 may radially extend into flow path 106 and may be impacted by the flow of flue gas (arrow F) directed by stator vanes 120, thereby causing rotation of rotor blades 140 and rotary disc 128 about center axis 124.

The disclosure will proceed to describe below structural and/or operational relationships of components and/or features of a disclosed seal and damping assembly interposed between any two adjacent blade platforms 146.

Figure 2:
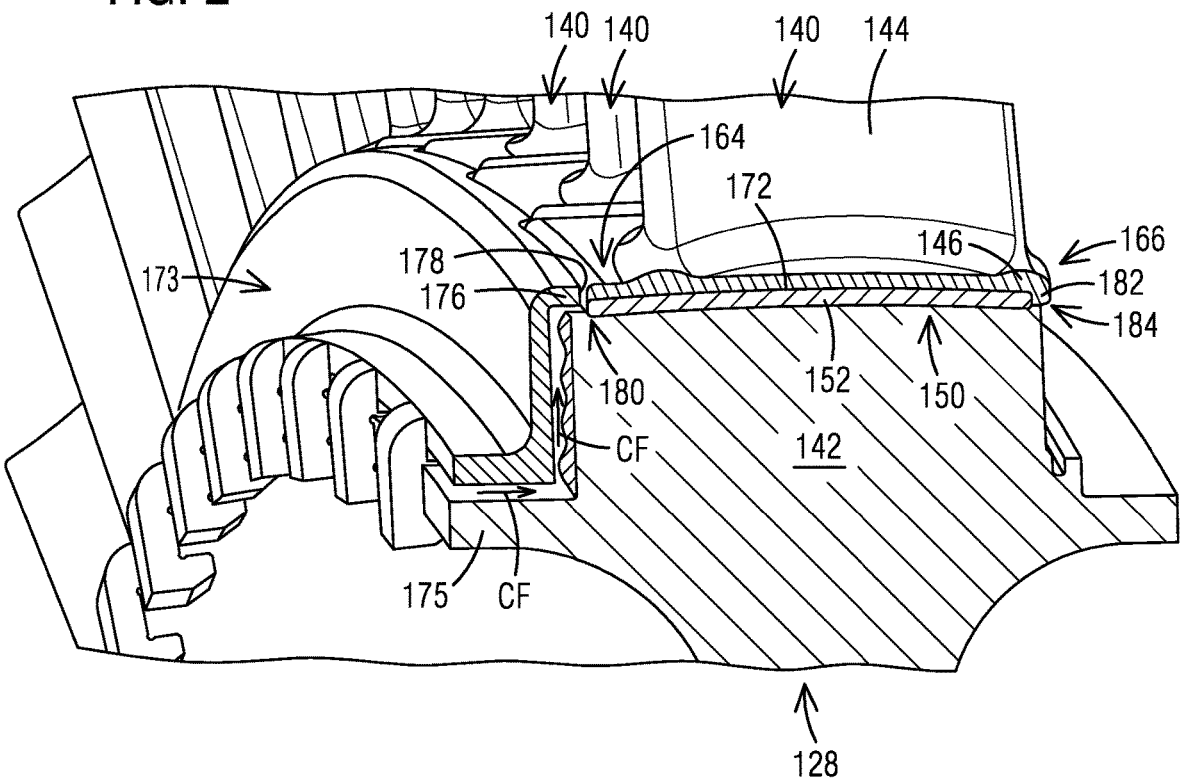
FIG. 2 is a fragmentary, isometric showing in part a row of circumferentially-arranged rotor blades in the turbomachinery and including a sectional view of a seal and damper member of a disclosed platform seal and damper assembly.
Figure 3:
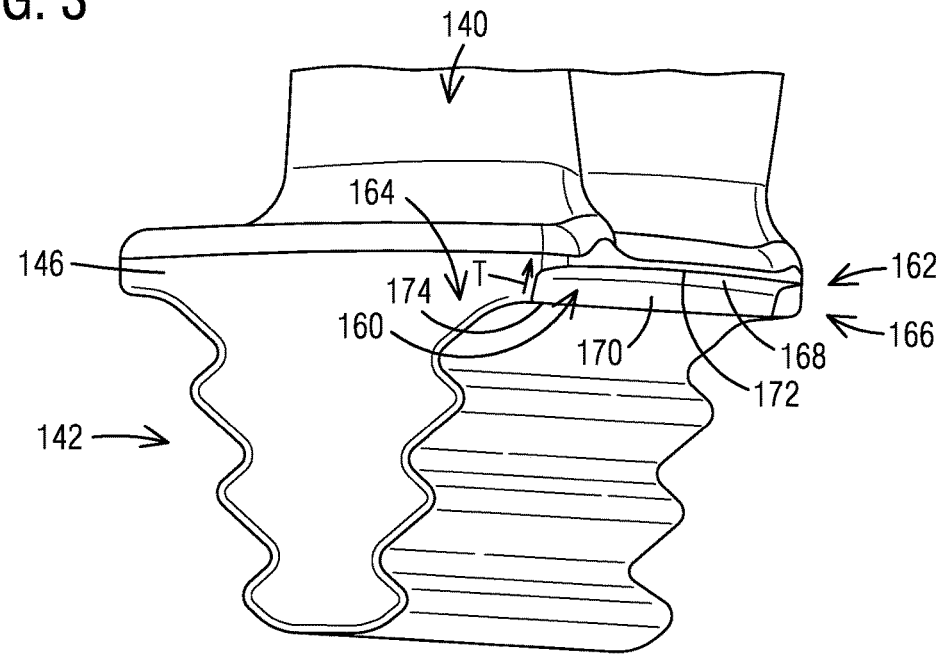
FIG. 3 is an isometric view illustrating a disclosed axially-extending groove configured on one side of a disclosed blade platform.

FIG. 2 is a fragmentary, isometric in part illustrating a row of circumferentially-arranged rotor blades 140 in the turbomachinery and including a sectional view of a disclosed platform seal and damper assembly 150 that may include a disclosed seal and damper member 152 to be disposed in a disclosed axially-extending groove 160 (FIG. 3).

As can be appreciated in FIG. 3, axially-extending groove 160 may be arranged on one side (e.g., side 162) of platform 146 between a leading edge 164 and a trailing edge 166 thereof. Without limitation, axially-extending groove 160 may be defined by a pair of surfaces 168, 170, where a radially-outward surface 168 of the pair of surfaces 168, 170 may be arranged at an underside of platform 146 and may be configured to define an arc 172 between the leading edge and the trailing edge of the respective platform, and further wherein a surface 170 of the pair of surfaces 168, 170 is arranged to extend with a tangential component (schematically represented by arrow T) from a radially-inward edge of 174 of groove 160 toward the radially-outward surface 168 arranged at the underside of the platform. The pair of surfaces 168, 170 that define axially-extending groove 160 comprise adjoining surfaces.

In one non-limiting embodiment, as may be appreciated in FIG. 2, an annular cooling shield 173 may be disposed on a rim 175 of rotor disc 128 and may be arranged to direct respective flows of a cooling fluid (schematically represented by arrows CF) across respective roots of the plurality of blades 140. In one non-limiting embodiment, an axially-extending member 176 of annular cooling shield 173 has an edge 178 arranged to axially retain a first end 180 of seal and damper member 152.

In one non-limiting embodiment, trailing edge 166 of blade platform 146 includes a radially-extending protrusion 182 arranged to axially retain a second end 184 of seal and damper member 152. Second end 184 is opposite to the first end 180 of seal and damper member 152.

Figure 4:
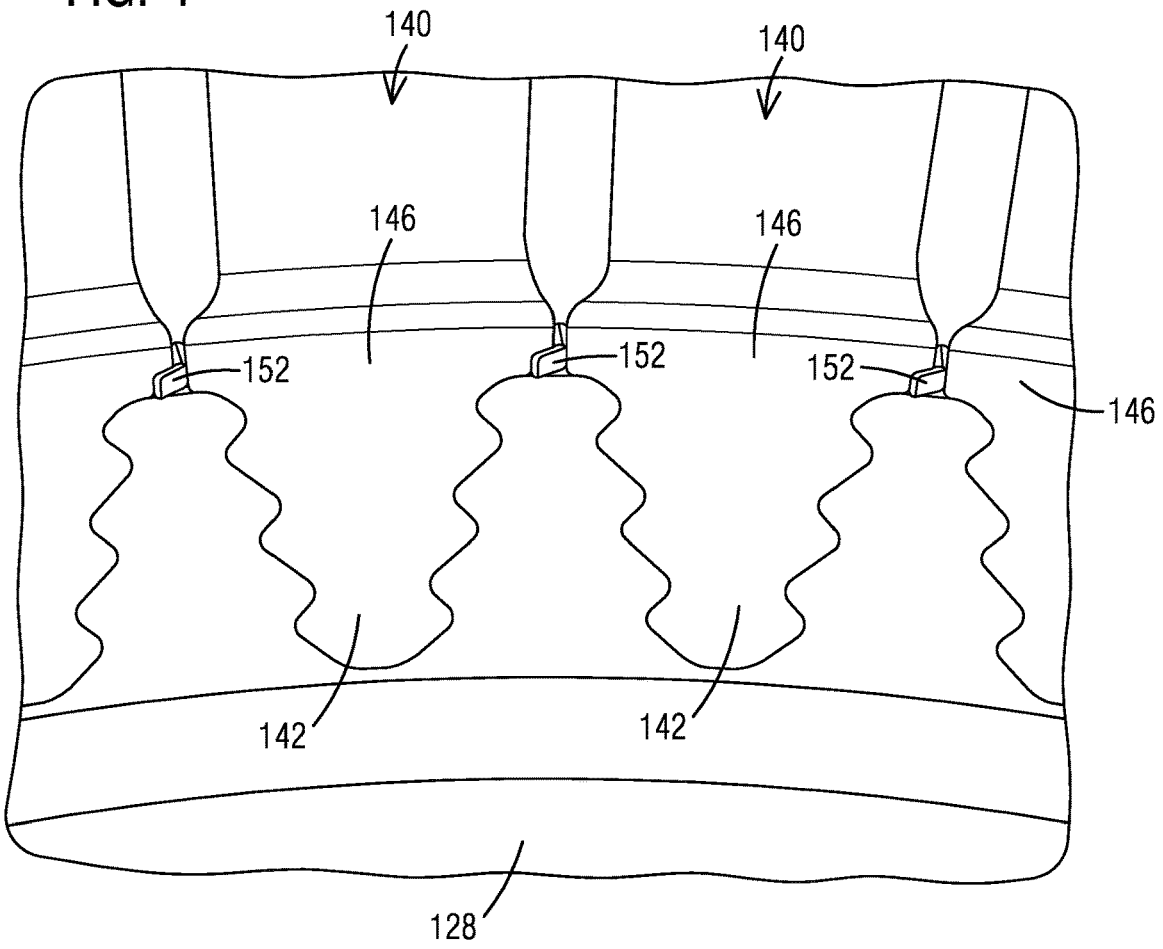
FIG. 4 is a fragmentary, axial view, as would be seen by an observer located upstream of a plurality of disclosed blade platforms with respective seal and damper members interposed between any two adjacent blade platforms of the plurality of blade platforms.
Figure 5:
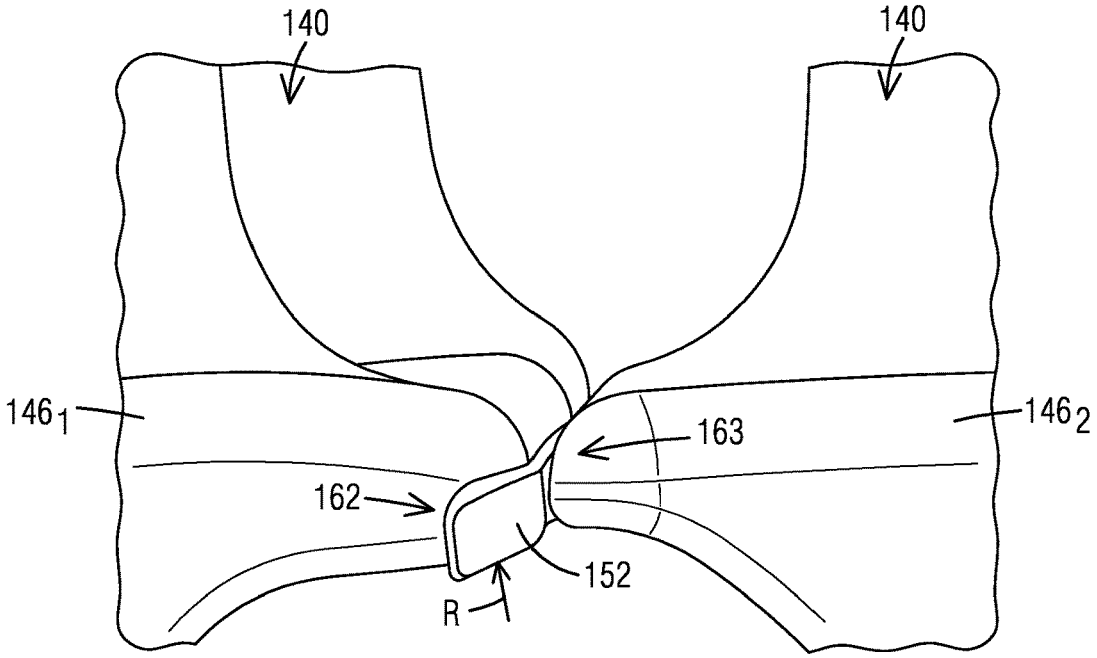
FIG. 5 is a fragmentary isometric, illustrating a zoomed-in view of two example adjacent blade platforms of the plurality of blade platforms.
Figure 6:
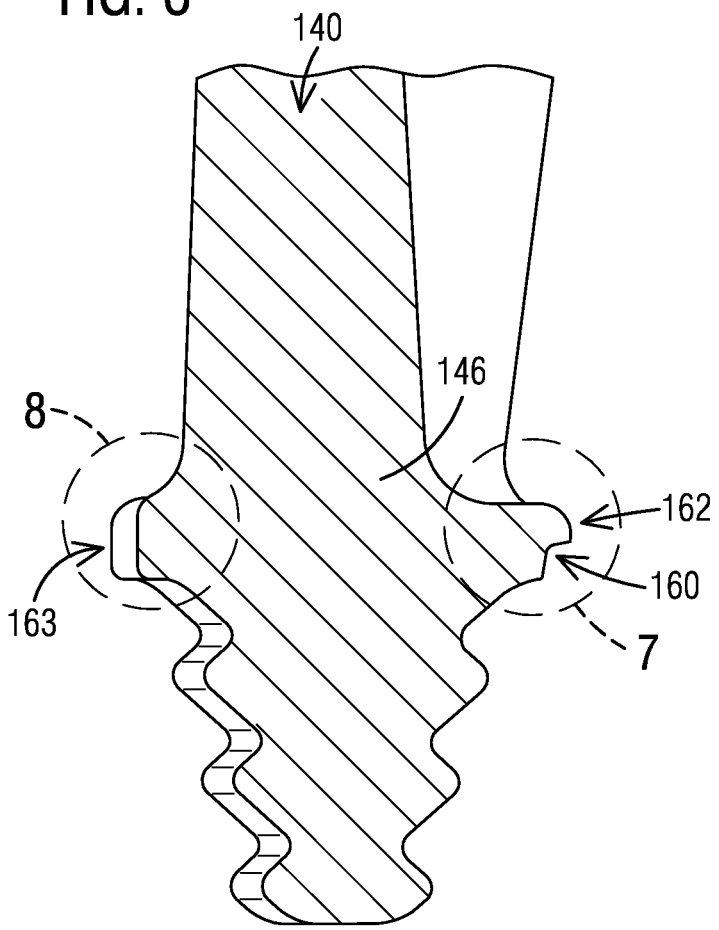
FIG. 6 is fragmentary sectional view in part illustrating respective contours of features on opposite sides of a disclosed blade platform.
Figure 7:
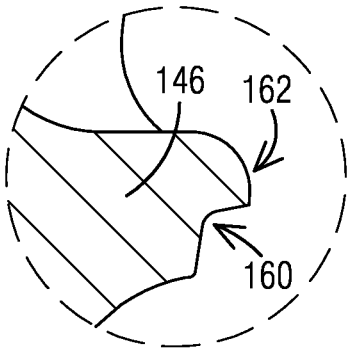
FIG. 7 is a zoomed-in view of a respective contour of features on one side of the opposite sides of the disclosed blade platform, such as on a side where the axially-extending groove may be configured.

FIG. 4 is a fragmentary, axial view as would be seen by an observer located upstream of a plurality of disclosed blade platforms 146 with respective disclosed seal and damper members 152 interposed between any two adjacent blade platforms. FIG. 5 shows a zoomed-in view of two example adjacent blade platforms $\mathbf{146}_1$, $\mathbf{146}_2$ of the plurality of blade platforms 146 including a respective seal and damper member 152 interposed therebetween. In this non-limiting example, adjacent blade platform $\mathbf{146}_1$ may be configured to include axially-extending groove 160 on one side (e.g., side 162) of platform $\mathbf{146}_1$. A contour of the groove 160 configured on side 162 of platform $\mathbf{146}_1$ may be appreciated in FIG. 6 and in the zoomed-in view shown in FIG. 7.

Figure 8:
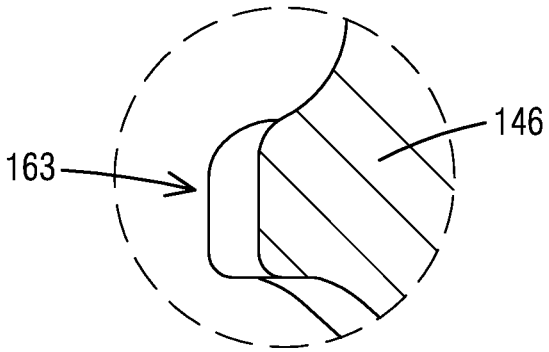
FIG. 8 is a zoomed-in view of the other side of the opposite sides of the disclosed blade platform, such as on a side not having an axially-extending groove.
Figure 9:
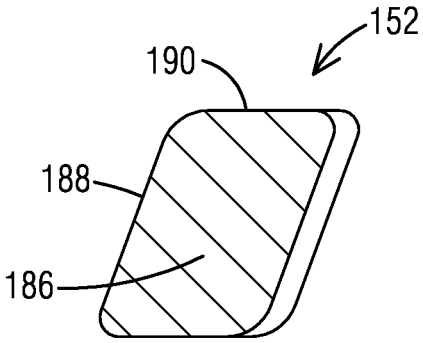
FIG. 9 is a fragmentary isometric illustrating a sectional view of the body of a disclosed seal and damper member.

Continuing with the non-limiting example shown in FIG. 5, adjacent blade platform $\mathbf{146}_2$ need not include any groove on the side (e.g., side 163) of platform $\mathbf{146}_2$ opposite to side 162 of platform $\mathbf{146}_1$. A contour of side 163 of platform $\mathbf{146}_2$ may be appreciated in FIG. 6 and in the zoomed-in view shown in FIG. 8. That is, without limitation, the axially-extending groove that receives the respective seal and damper member 152 may be configured on just one (e.g., side 162) of the mutually opposite sides of any two adjacent platforms, such as adjacent blade platforms $\mathbf{146}_1$, $\mathbf{146}_2$. It will be appreciated that the respective functional/structural roles of sides 162 and 163 may be reversed.

In one non-limiting embodiment, a cross-section 186 of the body that forms seal and damper member 152 may comprise, without limitation, a parallelogram-shaped cross-section. The body seal and damper member 152 includes a pair of adjoining surfaces 190, 188 (e.g., camming surfaces) configured to respectively engage in response to a camming action the pair of surfaces 168, 170 (FIG. 3) that define axially-extending groove 160. The labeling of such surfaces presumes a visualization in correspondence with the visualization of groove 170 in FIG. 3. The camming action is caused by centrifugal force (schematically represented by arrow R, FIG. 5) that develops during rotation of the rotor disc about a rotation axis (124). The camming action is effective to produce an interference fit of the seal and damper member (152) with the side of the respective platform (162) and an opposed side (163) of an adjacent platform.

Figure 10:
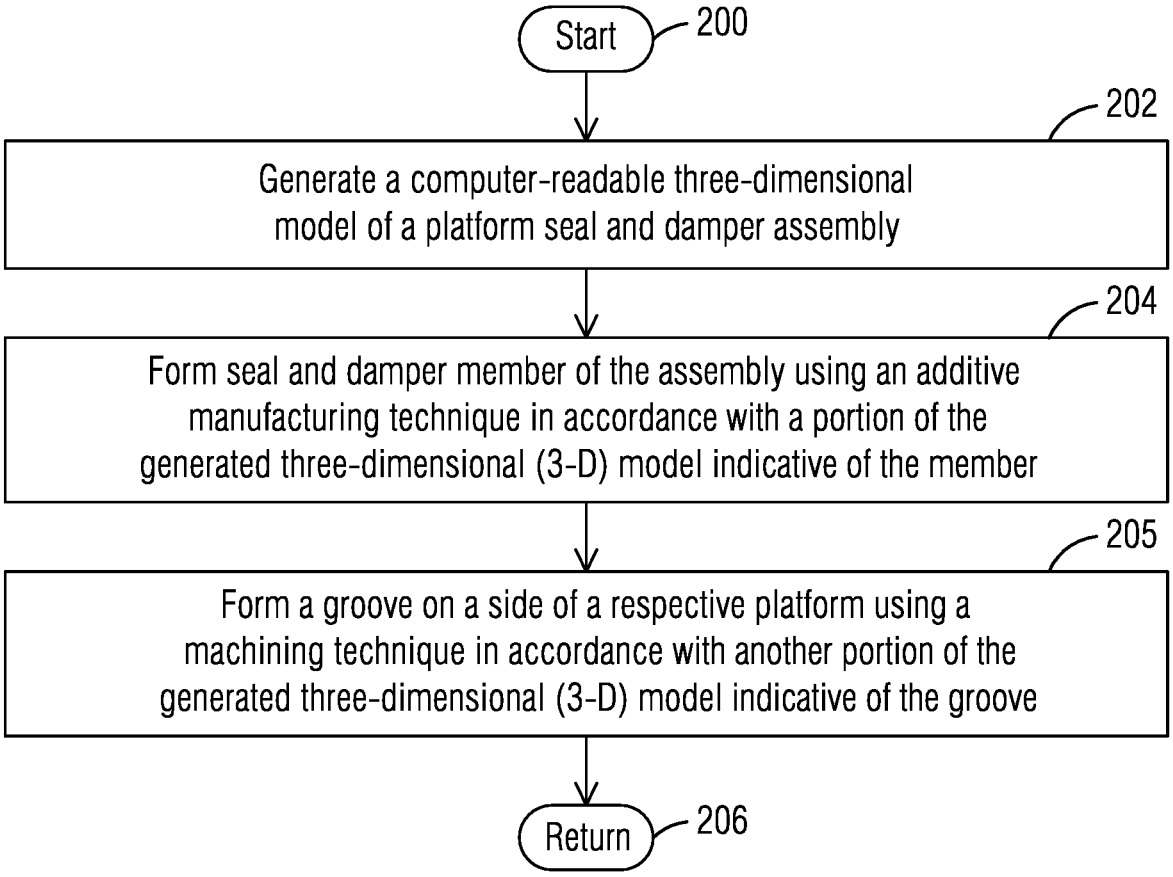
FIG. 10 is a flow chart listing certain steps that may be used in a method for forming features and/or components of disclosed platform seal and damper assemblies.

FIG. 10 is a flow chart listing certain non-limiting steps that may be used in a method for manufacturing a disclosed platform seal and damper assembly for turbomachinery, such as FCC expanders or gas turbine engines. As shown in FIG. 10, after a start step 200, step 202 allows generating a computer-readable three-dimensional (3D) model, such as a computer aided design (CAD) model, of a disclosed platform seal and damper assembly. Without limitation, the model can define a digital representation of a disclosed seal and damper member 152 (FIG. 2) and/or geometric features that define the axially-extending groove 160 (FIG. 3) to be configured on one side (e.g., side 162) of any two mutually adjacent platforms that receive the respective seal and damper member 152, as described above in the context of the preceding figures. Step 204 allows forming the seal and damper member using an additive manufacturing technique in accordance with a portion of the generated three-dimensional model indicative of the seal and damper member. Prior to return step 206, step 205 allows forming the axially-extending groove using a machining technique in accordance with another portion of the generated three-dimensional model indicative of the axially-extending groove to be configured on one side (e.g., side 162) of any two mutually adjacent platforms. It will be appreciated that forming steps 204, 205 need not be performed in any particular temporal sequence. For example, member-forming step 204 may be performed before groove-forming step 205; alternatively, member-forming step 204 may be performed either after groove-forming step 205, or concurrently with groove-forming step.

Non-limiting examples of additive manufacturing techniques to form the seal and damper member may include laser sintering, selective laser melting (SLM), direct metal laser sintering (DMLS), electron beam sintering (EBS), electron beam melting (EBM), etc. Non-limiting examples of machining techniques that may be used to configure the axially-extending groove may include electrical discharge machining, electrochemical machining, etc. It will be appreciated that once a model has been generated, or otherwise available (e.g., loaded into a 3D digital printer, or loaded into a processor that controls the additive manufacturing technique and/or the machining technique), then forming steps 204, 205 need not be preceded by a generating step 202.

Figure 11:
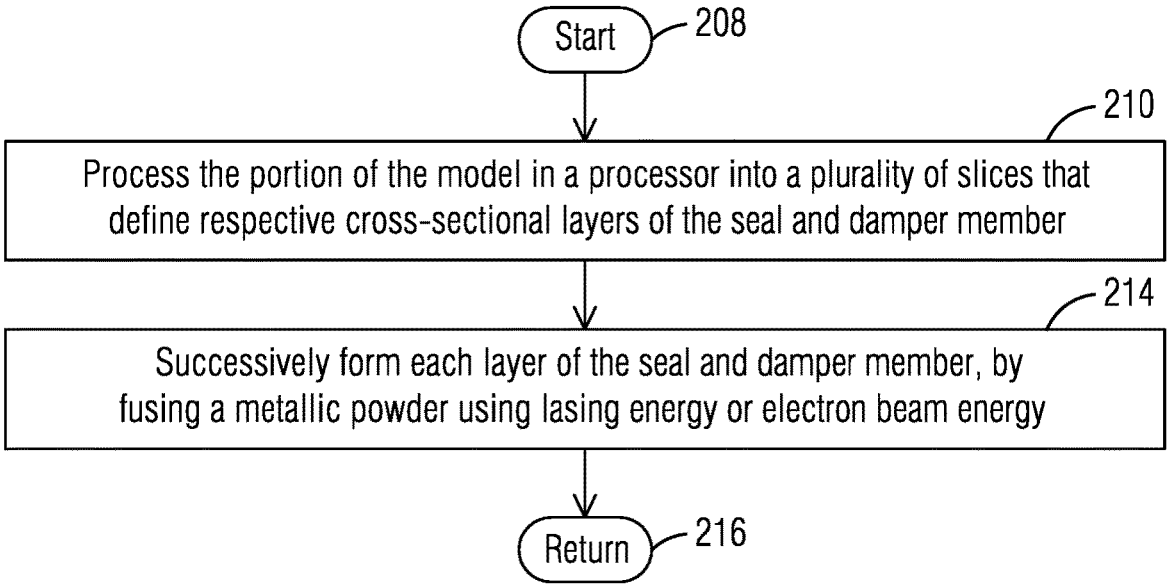
FIG. 11 is a flow chart listing further steps that may be used in the method in connection with the forming of a disclosed seal and damper member used in a disclosed platform seal and damper assembly.

FIG. 11 is a flow chart listing further steps that may be used in the disclosed method for manufacturing the seal and damper member. In one non-limiting embodiment, member-forming step 204 (FIG. 10) may include the following: after a start step 208, step 210 allows processing the portion of the three-dimensional model indicative of the seal and damper member in a processor into a plurality of slices of data that define respective cross-sectional layers of the seal and damper member. Prior to return step 216, step 214 allows successively forming each layer of the seal and damper member by fusing a metallic powder using a suitable source of energy, such as without limitation, lasing energy or electron beam energy.

Figure 12:
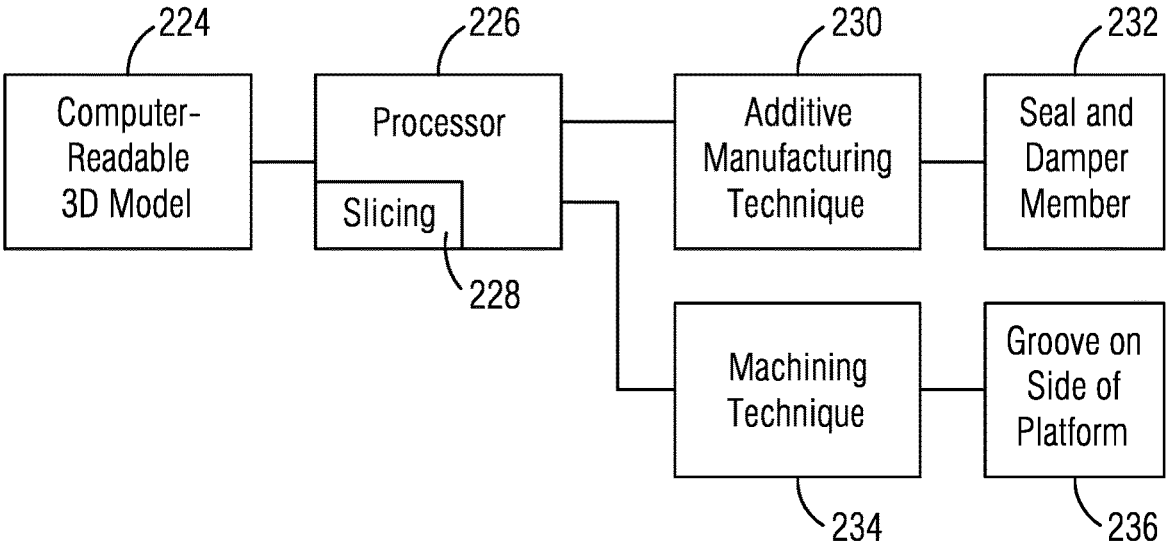
FIG. 12 is a flow sequence in connection with the method for forming disclosed platform seal and damper assemblies.

FIG. 12 is a flow sequence in connection with a disclosed method for forming a 3D object 232, such seal and damper member 152, and/or configuring in block 236 the geometric features (e.g., the pair of surfaces) that define the axially-extending groove to be configured on one side (e.g., side 162) of any two mutually adjacent platforms to receive respective seal and damper member 152. A portion of computer-readable three-dimensional (3D) model 224, such as a computer aided design (CAD) model indicative of the 3D object, may be processed in a processor 226 to control in block 230 an additive manufacturing technique. Without limitation, processor 226 may include a slicing module 228 that converts such portion of model 224 into a plurality of slice files (e.g., 2D data files) that defines respective cross-sectional layers of the 3D object. Processor 226 may be further configured to process another portion of the generated three-dimensional model indicative of the axially-extending groove to control in block 234 a machining technique to configure the geometric features that define the groove that receives the seal and damper member. It will be appreciated that processor 226 need not be a singular processor since, for example, at least a further processor may be used to perform the foregoing processing operations. Similarly, the digital representation of seal and damper member 152 (FIG. 2) and the digital representation of geometric features that define the axially-extending groove 160 (FIG. 3) need not be integrated in a singular three-dimensional (3D) model, since, for example, such digital representations could be embodied in separate models.

In operation, disclosed embodiments—in a cost-effective and reliable manner—provide a sealing functionality, which avoids or substantially reduces exposure of highly thermo-mechanically stressed regions, such as regions where rotor blades may be attached to the rotor disc, to the high-temperature flue gas. Additionally, in operation, disclosed assemblies are able to consistently remain engaged between any two adjacent blade platforms, notwithstanding of dynamically changing operational conditions that may occur during operation of the turbomachinery to effectively provide appropriate damping and sealing to the involved structures.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. A platform seal and damper assembly for turbomachinery having a rotor disc and a plurality of rotor blades, each rotor blade along a radial direction comprising a respective root configured to affix a respective rotor blade of the plurality of rotor blades to the rotor disc, a respective platform and a respective airfoil, the platform seal and damper assembly comprising:

an axially-extending groove arranged on a side of the respective platform between a leading edge and a trailing edge thereof, wherein the axially-extending groove is defined by a pair of surfaces, wherein a radially-outward surface of the pair of surfaces is arranged at an underside of the platform and is configured to define an arc between the leading edge and the trailing edge of the respective platform, and further wherein a surface of the pair of surfaces is arranged to extend with a tangential component (T) from a radially-inward edge of the groove toward the radially-outward surface arranged at the underside of the platform;

a seal and damper member disposed in the axially-extending groove, wherein the seal and damper member comprises a body having a pair of adjoining surfaces configured to respectively engage, in response to a camming action, with the pair of surfaces that define the axially-extending groove, the camming action caused by centrifugal force (R) that develops during rotation of the rotor disc about a rotation axis, the camming action effective to produce an interference fit of the seal and damper member with the side of the respective platform and an opposed side of an adjacent platform; and an annular cooling shield disposed on a rim of the rotor disc and arranged to direct respective flows of a cooling fluid across respective roots of the plurality of blades, wherein an axially-extending member of the annular cooling shield has an edge arranged to axially retain a first end of the seal and damper member.

2. The platform seal and damper assembly of claim 1, wherein the turbomachinery comprises a fluidized catalytic cracking (FCC) expander.

3. The platform seal and damper assembly of claim 1, wherein the turbomachinery comprises a gas turbine engine.

4. The platform seal and damper assembly of claim 1, wherein the trailing edge includes a radially-extending protrusion arranged to axially retain a second end of the seal and damper member, the second end of the seal and damper member being opposite to the first end of the seal and damper member.

5. The platform seal and damper assembly of claim 1, wherein a cross-section of the body of the seal and damper member comprises a parallelogram-shaped cross-section.

6. The platform seal and damper assembly of claim 1, wherein the pair of surfaces that define the axially-extending groove comprise adjoining surfaces.

7. A method of forming a platform seal and damper assembly for turbomachinery having a rotor disc and a plurality of rotor blades, the method comprising:

forming an axially-extending groove on a side of a respective platform between a leading edge and a trailing edge thereof, the forming of the axially-extending groove comprising:

defining the axially-extending groove by a pair of surfaces;

arranging a radially-outward surface of the pair of surfaces at an underside of the respective platform;

configuring the radially-outward surface of the pair of surfaces to define an arc between the leading edge and the trailing edge of the respective platform; and configuring a surface of the pair of surfaces to extend with a tangential component (T) from a radially-inward edge of the groove toward the radially-outward surface arranged at the underside of the respective platform;

forming a seal and damper member; and disposing the seal and damper member in the axially-extending groove, wherein the seal and damper member comprises a body having a pair of adjoining surfaces configured to respectively engage with the pair of surfaces that define the axially-extending groove in response to a camming action, wherein the camming action is caused by centrifugal force (R) that develops during rotation of the rotor disc about a rotation axis, the camming action effecting an interference fit of the seal and damper member with the side of the respective platform and an opposed side of a platform adjacent to the respective platform, wherein the forming of the axially-extending groove comprises a machining technique to machine the side of the respective platform to configure the pair of surfaces that define the axially-extending groove.

8. The method of claim 7, wherein the machining technique comprises electrical discharge machining.

9. The method of claim 7, wherein the machining technique comprises electrochemical machining.

10. A method of forming a platform seal and damper assembly for turbomachinery having a rotor disc and a plurality of rotor blades, the method comprising:

forming an axially-extending groove on a side of a respective platform between a leading edge and a trailing edge thereof, the forming of the axially-extending groove comprising:

defining the axially-extending groove by a pair of surfaces;

arranging a radially-outward surface of the pair of surfaces at an underside of the respective platform;

configuring the radially-outward surface of the pair of surfaces to define an arc between the leading edge and the trailing edge of the respective platform; and configuring a surface of the pair of surfaces to extend with a tangential component (T) from a radially-inward edge of the groove toward the radially-outward surface arranged at the underside of the respective platform;

forming a seal and damper member; and disposing the seal and damper member in the axially-extending groove, wherein the seal and damper member comprises a body having a pair of adjoining surfaces configured to respectively engage with the pair of surfaces that define the axially-extending groove in response to a camming action, wherein the camming action is caused by centrifugal force (R) that develops during rotation of the rotor disc about a rotation axis, the camming action effecting an interference fit of the seal and damper member with the side of the respective platform and an opposed side of a platform adjacent to the respective platform, wherein the forming of the seal and damper member is by way of an additive manufacturing technique.

11. A method of forming a platform seal and damper assembly for turbomachinery having a rotor disc and a plurality of rotor blades, each rotor blade along a radial direction comprising a respective root configured to affix a respective rotor blade of the plurality of rotor blades to the rotor disc, a respective platform and a respective airfoil, the method comprising:

generating a computer-readable three-dimensional (3D) model of the platform seal and damper assembly, the model defining a digital representation comprising:

an axially-extending groove to be machined on a side of the respective platform between a leading edge and a trailing edge thereof, processing the digital representation of the axially-extending groove in a processor configured to control a machining technique to configure the axially-extending groove on the side of the respective platform, wherein the axially-extending groove is defined by a pair of surfaces configured by the machining technique, wherein a radially-outward surface of the pair of surfaces being arranged at an underside of the platform and is configured to define an arc between the leading edge and the trailing edge of the respective platform, and wherein a surface of the pair of surfaces being arranged to extend with a tangential component (T) from a radially-inward edge of the groove toward the radially-outward surface arranged at the underside of the platform;

the model further defining a digital representation comprising:

a body of a seal and damper member to be disposed in the axially-extending groove machined on the side of the respective platform, the body of the seal and damper member having a pair of adjacent surfaces configured to respectively engage, in response to a camming action, with the pair of surfaces that define the axially-extending groove, the camming action caused by centrifugal force (R) that develops during rotation of the rotor disc about a rotation axis, the camming action effective to produce an interference fit of the seal and damper member with the side of the respective platform and an opposed side of an adjacent platform; and forming the seal and damper member using an additive manufacturing technique in accordance with the digital representation of the body of the seal and damper member.

12. The method of claim 11, wherein the machining technique comprises electrical discharge machining.

13. The method of claim 11, wherein the machining technique comprises electrochemical machining.

14. The method of claim 11, wherein the forming of the seal and damper member is performed before a machining of the axially-extending groove.

15. The method of claim 11, wherein the forming of the seal and damper member is performed after a machining of the axially-extending groove.

16. The method of claim 11, wherein the forming of the seal and damper member is performed concurrent with a machining of the axially-extending groove.

* * * * *